United States Patent [19]

Beier

[11] Patent Number: 4,810,034

[45] Date of Patent: Mar. 7, 1989

[54] BACKREST WITH ADJUSTABLE LUMBER SUPPORT

[76] Inventor: John K. Beier, 901 S. 89th St., Omaha, Nebr. 68114

[21] Appl. No.: 125,694

[22] Filed: Nov. 27, 1987

[51] Int. Cl.[4] ..... A47C 7/46

[52] U.S. Cl. ..... 297/284; 5/447; 297/231; 297/460

[58] Field of Search ..... 297/230, 231, 284, 460, 297/458, 459; 5/432, 434, 437, 446, 447

[56] References Cited

U.S. PATENT DOCUMENTS

| | | | |
|---|---|---|---|
| 2,894,565 | 7/1959 | Conner | 297/284 X |
| 3,276,046 | 10/1966 | Capelli | 5/437 |
| 3,495,871 | 2/1970 | Resag et al. | 297/284 |
| 3,974,827 | 8/1976 | Bodeen | 297/284 X |
| 4,362,334 | 12/1982 | Ross et al. | 297/284 X |
| 4,541,670 | 9/1985 | Morgenstern et al. | 297/284 |
| 4,555,084 | 11/1985 | Anderson | 248/558 X |
| 4,555,137 | 11/1985 | Goldner | 297/460 |
| 4,718,724 | 1/1988 | Quinton et al. | 297/284 |

*Primary Examiner*—Peter R. Brown

*Attorney, Agent, or Firm*—Zarley, McKee, Thomte Voorhees & Sease

[57] ABSTRACT

A backrest having a lumbar support cushion selectively vertically adjustably positioned thereon to accommodate the physical structure of the particular person utilizing the backrest. Support cushions having various thicknesses may also be utilized. The backrest has a plurality of vertically spaced, horizontal grooves, and the lumbar cushion has a horizontal tongue for releasable connection in the backrest grooves.

6 Claims, 3 Drawing Sheets

BACKREST WITH ADJUSTABLE LUMBER SUPPORT

BACKGROUND OF THE INVENTION

This invention relates to a backrest and more particularly to a backrest having an adjustable lumbar support.

Many types of backrests have been previously provided which include various types of supports for the lumbar area of a person. However, the devices of the prior art are either extremely cumbersome, complicated or difficult to use. Further, prior art devices do not have means for vertically adjusting the lumbar support as well as means for increasing the thickness of the lumbar support.

It is therefore a principal object of the invention to provide an improved backrest.

A further object of the invention is to provide a backrest having a lumbar support removably positioned thereon which may be vertically adjusted.

Still another object of the invention is to provide a backrest having a lumbar support removably positioned thereon to enable lumbar supports of various thicknesses to be mounted thereon.

Still another object of the invention is to provide a backrest of the type described which may be quickly and easily adjusted to accommodate the particular person utilizing the backrest.

Yet another object of the invention is to provide a backrest which is economical of manufacture, durable in use and refined in appearance.

These and other objects will be apparent to those skilled in the art.

SUMMARY OF THE INVENTION

A backrest is described which is comprised of a resilient upstanding member having a resilient lumbar support cushion selectively vertically secured thereto. The vertical adjustment of the lumbar support permits the lumbar support to accommodate the particular person utilizing the backrest. Further, if a lumbar support of a greater thickness is desired, the lumbar support may be removed and substituted by a lumbar support having a greater thickness. An outer cover encloses the entire backrest.

DESCRIPTION OF THE PREFERRED EMBODIMENT

Figure 1:
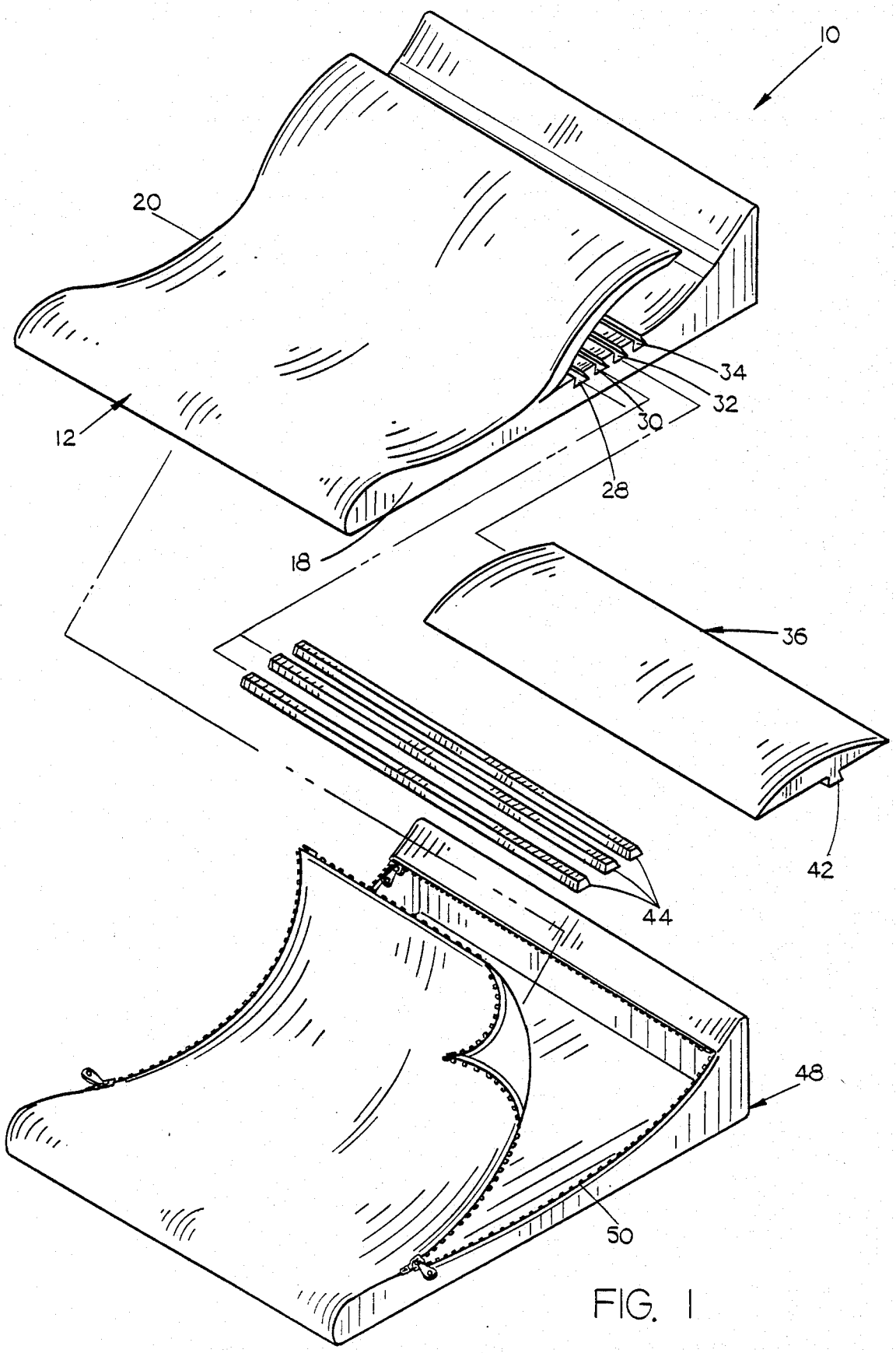
FIG. 1 is an exploded perspective view of the backrest of this invention.

The preferred backrest of this invention is illustrated in FIG. 1 and is referred to generally by the reference numeral 10. Backrest 10 is comprised of a resilient, upstanding back member 12 having an upper end 14, lower end 16, opposite sides 18 and 20, back portion 22 and front portion 24. In the preferred embodiment, a flap 26 is provided for a purpose to be described in more detail hereinafter.

Figure 6:
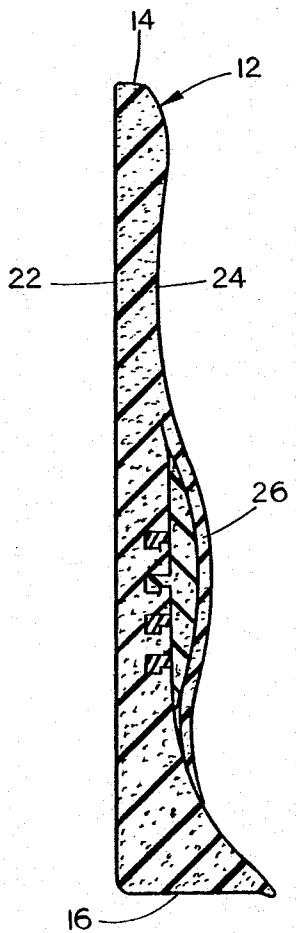
FIG. 6 is a sectional view illustrating a modified form of the tongue and groove connection means.
Figure 5:
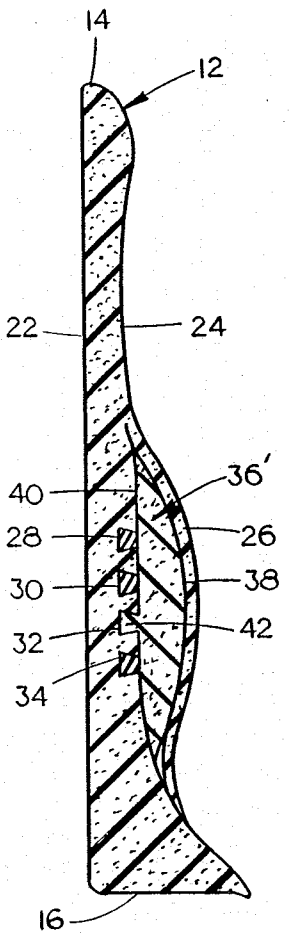
FIG. 5 is a view similar to FIGS. 3 and 4 except that a lumbar support having a greater thickness is shown.

Front portion 24 is provided with a plurality of horizontally disposed and vertically spaced grooves 28, 30, 32 and 34 formed therein behind flap 26. As seen in FIG. 5, the grooves 28, 30, 32 and 34 may either have a dovetail configuration or the L-shaped configuration illustrated in FIG. 6. Further, the grooves could have a rectangular cross-section if so desired.

The numeral 36 refers to a resilient lumbar support cushion having an arcuate or curved front portion 38 and a substantially vertically disposed back portion 40. Cushion 36 is provided with one or more tongues 42 which extend rearwardly therefrom and which have a cross-sectional configuration complementary to the grooves 28, 30, 32 and 34. The lumbar support cushion 36 is secured to the back member 12 by inserting the tongue 42 into the appropriate groove 28, 30, 32 or 34. Cushion 36 may be vertically adjusted relative to back member 12 by inserting the tongue 42 in the desired groove 28, 30, 32 and 34. Preferably, those grooves which are not occupied by the tongue 42 are filled by elongated strips 44 which also have a cross-sectional configuration complementary to the grooves. When the cushion 36 is mounted on the back member 12, flap 26 extends thereover. Flap 26 is not critical to the invention but it has been found that the flap aids in maintaining the cushion 36 in position.

Figure 4:
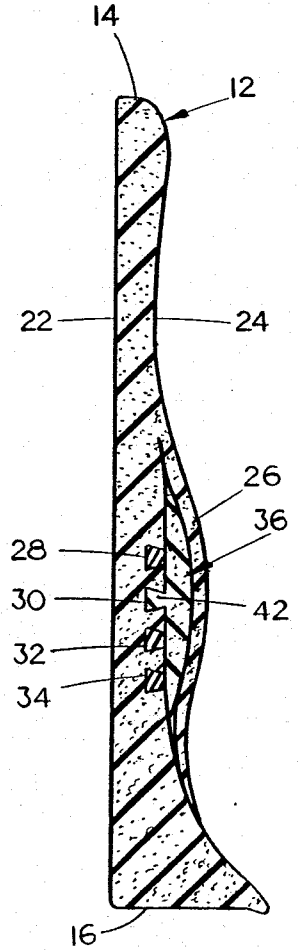
FIG. 4 is a sectional view similar to FIG. 3 except that the lumbar support has been vertically moved upwardly relative to the backrest.
Figure 3:
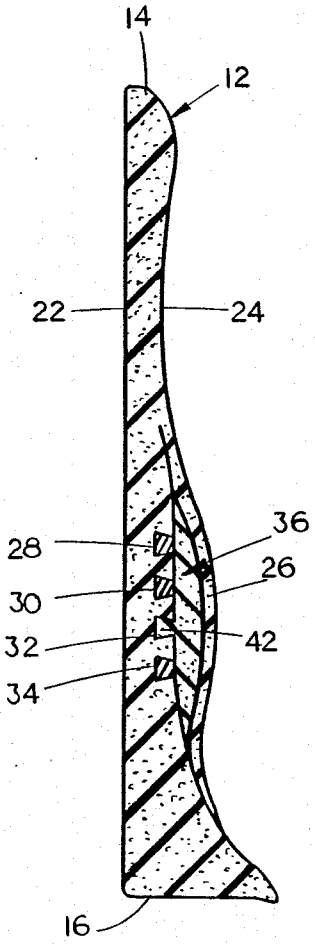
FIG. 3 is a vertical sectional view of the backrest.
Figure 2:
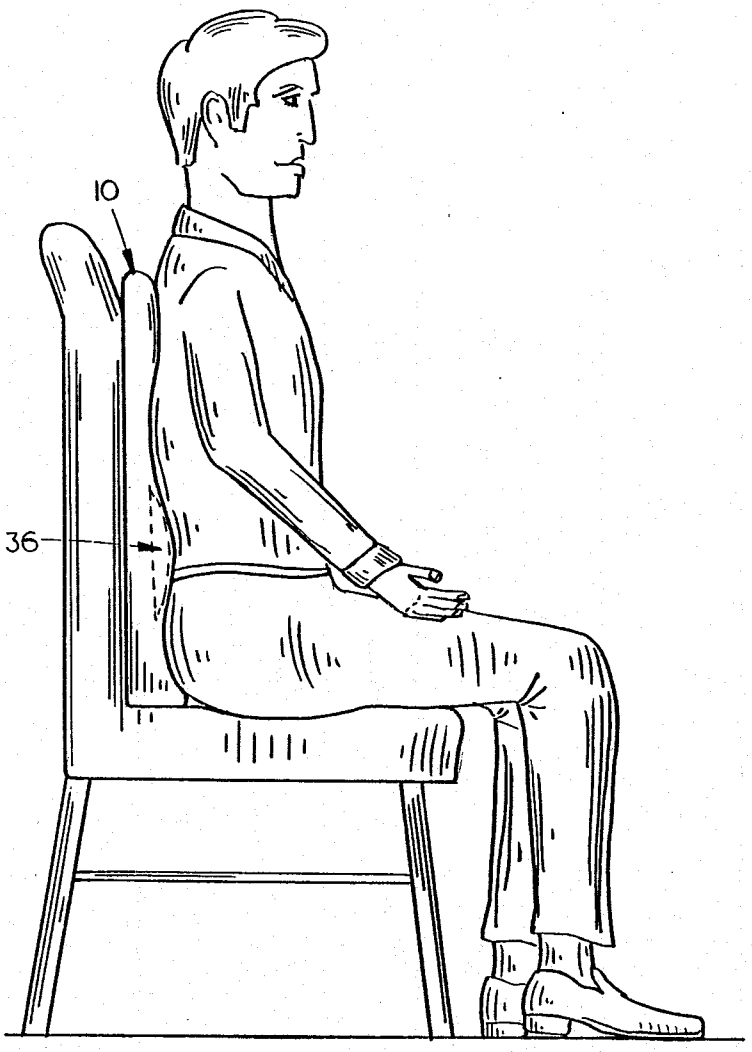
FIG. 2 is a side view illustrating the backrest of FIG. 1 being utilized.
Figure 8:
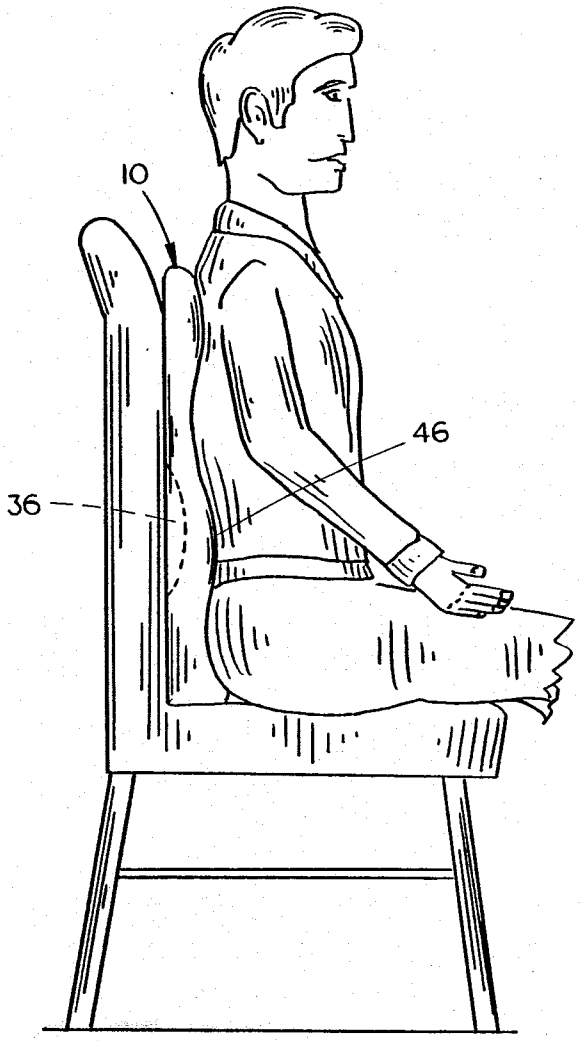
FIG. 8 is a view similar to FIG. 2 except that the backrest of FIG. 7 is illustrated.

As seen in FIG. 3, tongue 42 is received in groove 32. Cushion 36 may be vertically moved relative to back member 12 as illustrated in FIG. 4 by inserting the tongue 42 into groove 30.

When it is desired to increase the thickness of the lumbar support cushion, cushion 36 is removed from back member 12 and the cushion 36' is inserted. As seen in FIG. 5, cushion 36' has a greater thickness than the cushion 36 of FIGS. 3 and 4.

Figure 7:
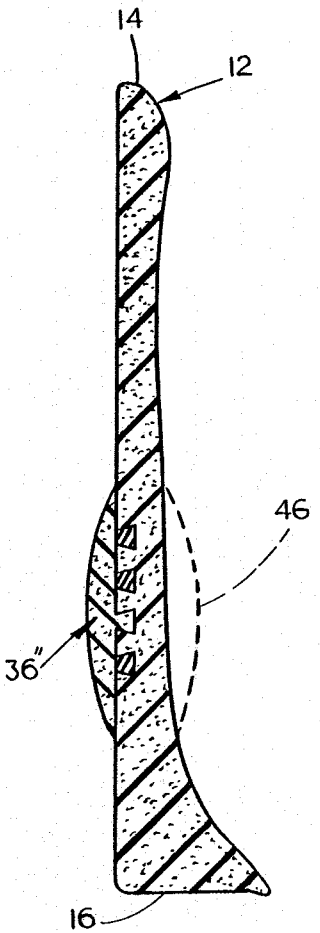
FIG. 7 is a vertical sectional view illustrating a modified form of the invention.

FIG. 7 illustrates a modified form of the invention in that the grooves are formed in the back portion of the backrest and the lumbar support cushion 36'' is mounted at the back of the back member 12. When the device of FIG. 7 is positioned on a chair, the forward portion of the chair pushes the support cushion 36'' forwardly so that the lumbar support is provided referred to generally by the reference numeral 46 and illustrated by broken lines in FIG. 7.

Preferably, the entire assembly is enclosed in a cover 48 having appropriate zippers 50 provided thereon so that access to the interior thereof is convenient. Thus it can be seen that a novel backrest has been provided which has an adjustable lumbar support cushion mounted thereon. The support cushion can be vertically moved to accommodate the particular person using the backrest. Likewise, if a lumbar support cushion having a greater thickness is desired, the lumbar support cushion may be substituted with a cushion having a greater thickness. Thus it can be seen that the invention accomplishes at least all of its stated objectives.

I claim:

1. A backrest having an adjustable lumbar support comprising, a resilient upstanding member having upper and lower ends, a front portion, a back portion, and opposite side edges, said resilient member having a plurality of vertically spaced, horizontally disposed grooves formed in its front portion above the lower end thereof, said grooves extending completely across the lateral dimension of said resilient member, a resilient lumbar support cushion having a back portion, a curved front portion, an upper end, a lower end, and opposite side edges, said lumbar support cushion having at least one horizontally disposed tongue means extending rearwardly from its back portion adapted to be selectively removably received in one of said grooves whereby the vertical position of said support cushion, with respect to said resilient member, may be selectively adjusted, said resilient member front portion including a flap portion depending from above said grooves and having dimension so as to completely cover said grooves and said lumbar support cushion in said grooves and to extend downwardly beyond said cushion, whereby a smooth, front surface is provided on said resilient member.

2. The backrest of claim 1 wherein a resilient strip member is removably positioned in each of said grooves other than the groove which receives said tongue means.

3. The backrest of claim 1 wherein said tongue means and said grooves have a dovetail configuration.

4. The backrest of claim 1 wherein said tongue means and said grooves have an L-shaped configuration.

5. The backrest of claim 1, wherein said flap portion is tapered to a thin edge along its depending edge.

6. The backrest of claim 1, further comprising a cover means enclosing said resilient member and support cushion, said cover means including a selectively closable flap portion located and having dimensions to provide access to said resilient member flap portion, to thereby allow adjustment of said lumbar cushion without removing said resilient member from said cover.

* * * * *